US005142806A

United States Patent [19]

Swan

[11] Patent Number: 5,142,806

[45] Date of Patent: Sep. 1, 1992

[54] UNIVERSAL RECEIVER SLEEVE

[76] Inventor: Richard E. Swan, 375 West St., W. Bridgewater, Mass. 02379

[21] Appl. No.: 763,966

[22] Filed: Sep. 23, 1991

[51] Int. Cl.[5] ..... F41C 27/00; F41G 1/387

[52] U.S. Cl. ..... 42/101

[58] Field of Search ..... 42/75.01, 100, 101, 42/103

[56] References Cited

U.S. PATENT DOCUMENTS 2,653,386 9/1953 Winton ..... 42/101

4,044,486 8/1977 Van Holten ..... 42/101

4,845,871 7/1989 Swan ..... 42/101

*Primary Examiner*—Charles T. Jordan

*Attorney, Agent, or Firm*—John P. McGonagle

[57] ABSTRACT

A sleeve added to the upper receiver of a firearm for incorporating firearm ancillary equipment. The sleeve has an upper enhancement interface portion and a lower firearm interface portion. The upper enhancement interface portion has standard, universal dimensions regardless of the firearm. The lower firearm interface portion is specific to the particular firearm the sleeve is integrated to.

17 Claims, 8 Drawing Sheets

UNIVERSAL RECEIVER SLEEVE

BACKGROUND OF THE INVENTION

This invention relates to integration means, and more particularly to a device added to the upper receiver of a firearm for incorporating firearm ancillary equipment.

As the field of combat weaponry expands, numerous add-on enhancements have become available for attachment to standard firearms thereby significantly upgrading the capability of the firearm. However, because of the variety of shapes of the upper receivers of different firearms, the add on enhancements must be modified each time they are sold for a different firearm. This also results in high cost for the add-on enhancements.

The Swan/Weaver rail described in U.S. Pat. No. 4,845,871, incorporated herein by reference and hereinafter referred to as '871, addresses a portion of this problem. The female portion of said rail is a quick detachable interface means for modular enhancements. However, the said rail requires a first rail (weaver rail) to be attached to the firearm, typically to the arced handle on the U.S. Army M16 combat firearm, and different means on other types. The first rail must be designed for each firearm to accommodate the differences between firearm receivers. Since the male portion of the Swan/Weaver rail is easily removed by the firearm operator, they are also easily lost and calibration and weapon sighting are difficult and nonuniform.

SUMMARY OF THE INVENTION

In view of the foregoing disadvantages inherent in the known types of devices now present in the prior art, the present invention provides a modular firearm receiver via a sleeve. As such, the general purpose of the present invention, which will be described subsequently in greater detail, is to provide a new and improved interface means for firearms which will present a standard interface to modular enhancements regardless of which type or manufacturer's firearm the sleeve is integrated to thus allowing a weapon's manufacturer to tailor a weapon to the specific capabilities of a customer without having to account for different receivers. The manufacturer of the rifle will be able to change receiver dimensions as easily as he now supplies different barrel lengths, which also attach to the receiver.

To attain this, the present invention has an upper enhancement interface portion and a lower firearm interface portion. The upper enhancement interface portion has standard, universal dimensions regardless of the firearm. The lower firearm interface portion is specific to the particular firearm the invention is integrated to. The sleeving system of the present invention lessens overall cost, as it eliminates the need for a wide range of interface adaptors.

The most significant aspects of the invention will allow a weapons manufacturer to build one basic firearm receiver and then tailor the rifle to various customer needs via an integral sleeve. The sleeve can be replaced by the manufacturer as technical advances warrant, thereby avoiding having to replace expensive receivers while still upgrading capabilities.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE PREFERRED EMBODIMENT

Figure 1:
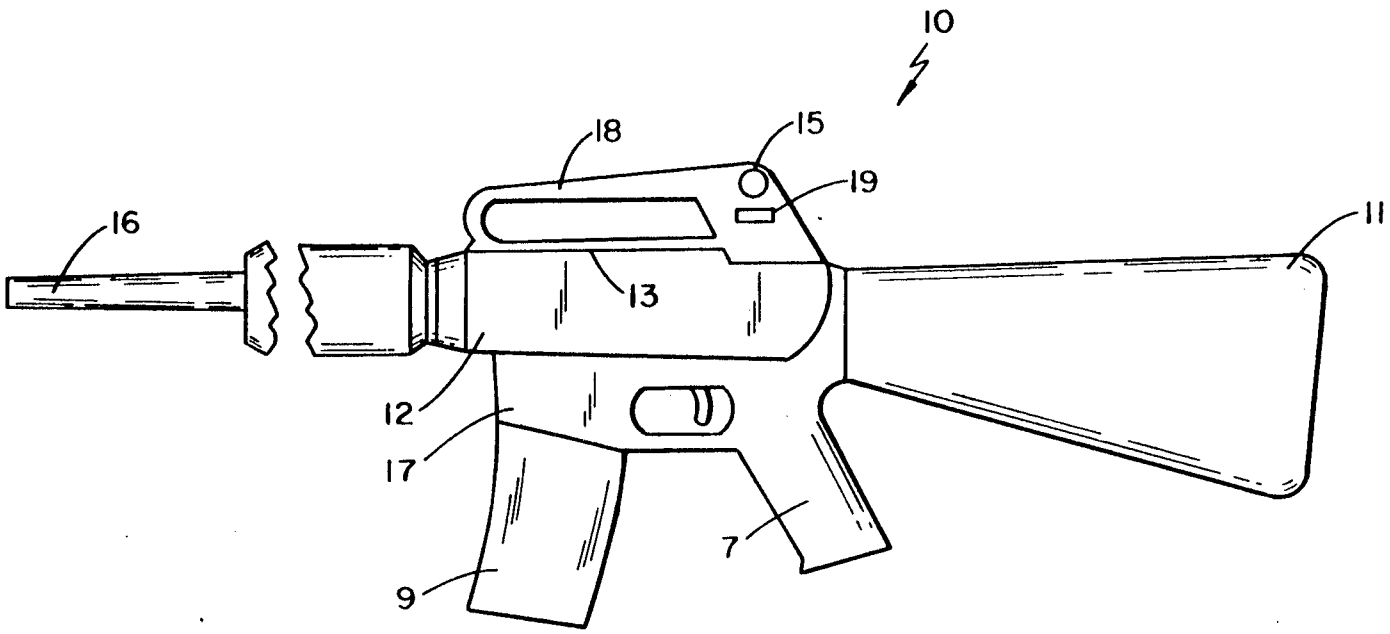
FIG. 1 is a side elevational view of a standard combat firearm.

Referring to the drawings in detail wherein like elements are indicated by like numerals, there is shown in FIG. 1 an outline of a conventional combat firearm 10 having a conventional stock 11, upper receiver 12, lower receiver 17, barrel 16, pistol grip 7, magazine 9 and arced handle 18 joined to the upper receiver 12. The barrel 16 is also joined to the upper receiver 12, i.e., the upper receiver 12 "receives" the barrel 16. The arced handle 18 has the after part of a non-optical bead sight with windage and elevational adjustment devices 15, 19 located at the rear thereof remote from the barrel 16.

Figure 2A:
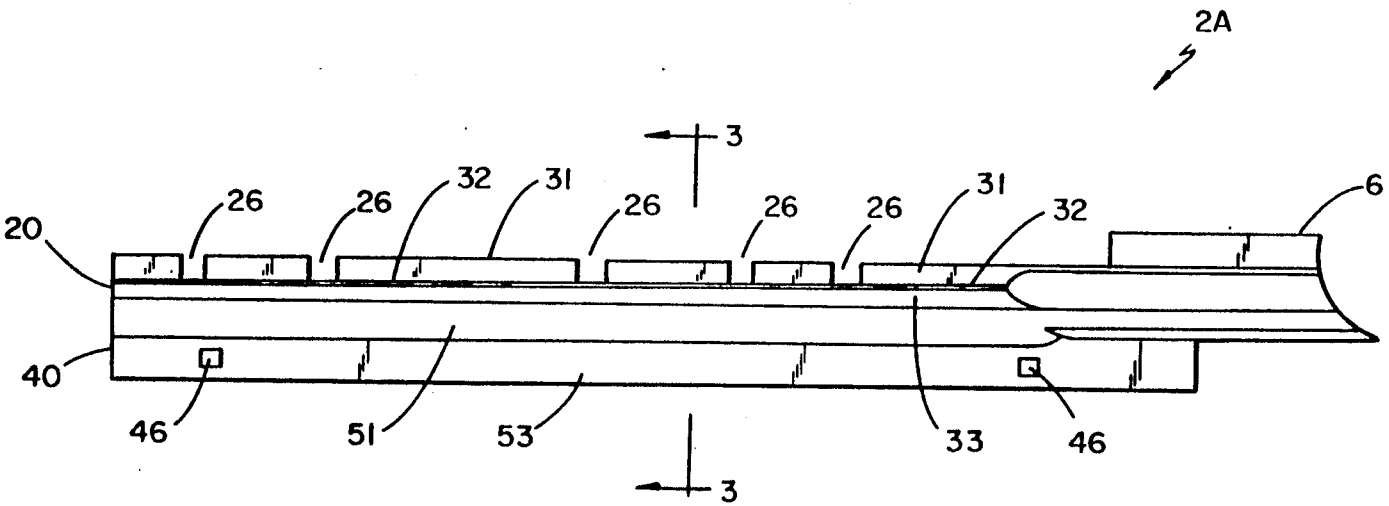
FIG. 2A is a side elevational view of a standard length receiver sleeve according to the present invention.
Figure 2B:
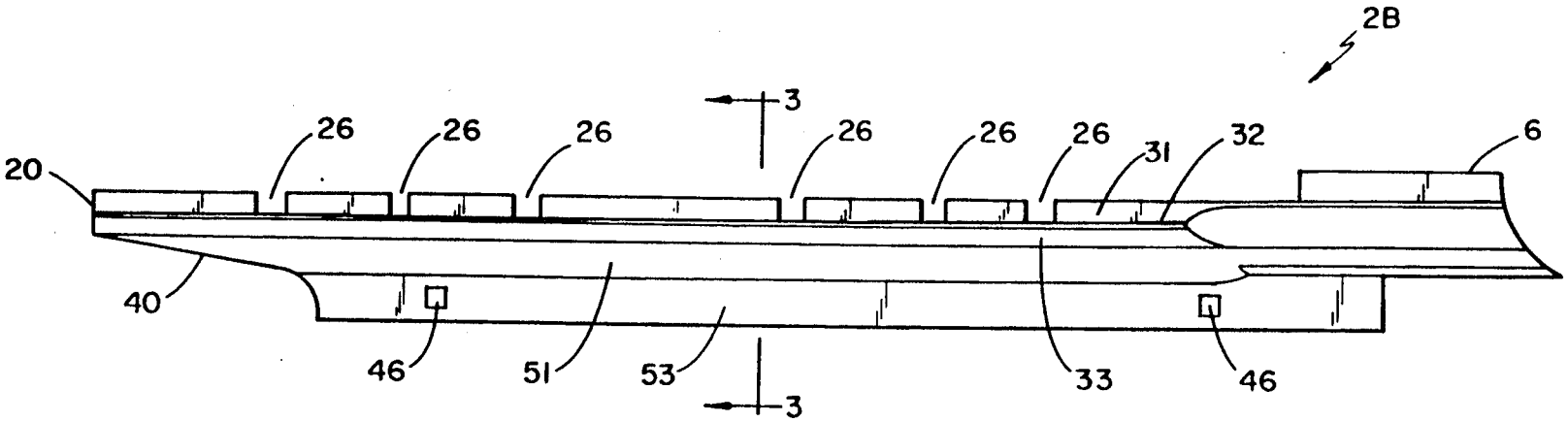
FIG. 2B is a side elevational view of an extended length receiver sleeve according to the present invention.
Figure 3:
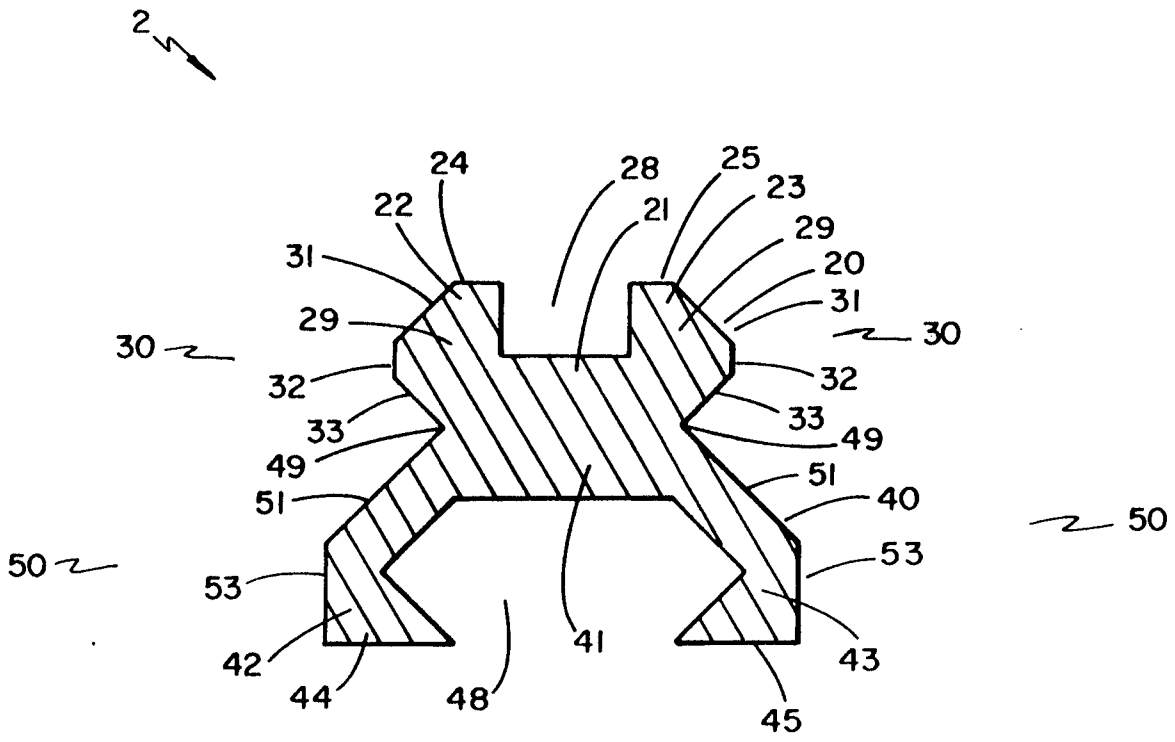
FIG. 3 is a cross sectional view along the lines 3—3 of FIGS. 2A and 2B.

In the present invention the handle 18 of the firearm 10 illustrated in FIG. 1 is removed and a receiver sleeve 2A of standard length as illustrated in FIG. 2A or a receiver sleeve 2B of extended length as illustrated in FIG. 2B is joined to the top 13 of the upper receiver 12. As may be seen in FIGS. 2A, 2B, and 3, the receiver sleeve 2 has a top section 20 and a bottom section 40 and a longitudinal axis extending in spaced, parallel relation to the longitudinal axis of the firearm 10. The receiver sleeve top section 20 has a longitudinal, horizontally positioned base portion 21 along its length. The base portion 21 has two long side edges 29. A first longitudinal rail 22 extends upward from the base portion 21 adjacent one of the long side edges 29 and a second longitudinal rail 23 extends upward from the base portion 21 adjacent the other of the long side edges 29. The second rail 23 is in spaced parallel relationship to the first rail 22. A longitudinal opening, i.e., channel 28, is formed between the first and second rails 22, 23. The upper surface 24 of the first rail 22 lies on the same horizontal plane as the upper surface 25 of the second rail 23.

Optional notches 26 may also be provided in the rails 22, 23. The notches 26 provide additional means of engaging other components. The quantity and placement of pairs of notches 26 are as required or needed. In this embodiment of the invention, a series of identical and facing, rectangular notches 26 are formed transversely through the first and second rails 22, 23 (second rail not shown), respectively, as shown in FIGS. 2A and 2B.

Each of the two long side edges 29 of the base portion 21 and rails 22, 23 are integral with external angled engagement surfaces 30 which extend the full length of the top section 20. The surfaces 30 each have a middle longitudinal section 32, upper longitudinal section 31, and lower longitudinal section 33. The upper section 31 surface planes are directed outwardly and downwardly at a forty-five degree angle from the horizontal planes of the rail upper surfaces 24, 25. The middle section 32 surface planes are directed vertically downwardly from the upper section 31 surface planes in planes perpendicular to the horizontal planes of the rail upper surface 24, 25 planes. The lower section 33 surface planes are directed inwardly and downwardly at a forty-five degree angle from the vertical planes of the middle sections 32 to the bottom section base side edges 49. In this embodiment of the invention, the longitudinal opening 28, having a rectangular U-shaped cross section, has a transverse width of 0.375 inch. The The outer transverse width of the receiver sleeve top section 20 is 0.835 inch. The transverse width of the bottom base side edges 49 is 0.630 inch. The dimensions of the receiver sleeve top section 20 remain the same regardless of the firearm the receiver sleeve 2 is attached to. This ensures that all modular enhancements need meet only one interface requirement, regardless of the firearm.

The receiver sleeve top section 20 is joined to the receiver sleeve bottom section 40. The receiver sleeve bottom section also has a longitudinal, horizontally positioned base portion 41 along its length. The base portion 41 has two long side edges 49. A first rail 42 extends downward from the base portion 41 adjacent one of the long side edges 49 and a second rail 43 extends downward from the base portion 41 adjacent the other of the long side edges 49. The second rail 43 is in spaced parallel relationship to the first rail 42. The top section base 21 is joined in a mirrored, face to face relationship to the bottom section base 41. The joining faces of both bases 21, 41 have the same dimensions.

The lower surface 44 of the first rail 42 lies on the same horizontal plane as the lower surface 45 of the second rail 43. Each of the two long side edges 49 of the base portion 41 and the rails 42, 43 are integral with an angled engagement surface 50 which extends the full length of the bottom section 40. The surface 50 has an upper longitudinal section 51 and a lower longitudinal section 53. The upper section 51 surface planes are directed outwardly and downwardly at a forty-five degree angle from the horizontal plane of the bottom section base 41. The lower section 53 planes are directed vertically downward from the upper section 51 surface planes to the lower surfaces 44, 45 of the first 42 and second 43 rails, respectively. A longitudinal resultant opening 48 is formed between the integrated rail-angled engagement surfaces 42, 50 and 43, 50. The cross section shape of the opening 48 will vary from firearm to firearm depending on the upper receiver top 13 contour of the particular firearm. The opening 48 is the interface and engagement means between the receiver sleeve 2 and the firearm 10. The nominal cross section of the opening 48 and the cross section of the receiver sleeve top section 20 are identical. This permits complex integration of various modules to a firearm 10.

Figure 4:
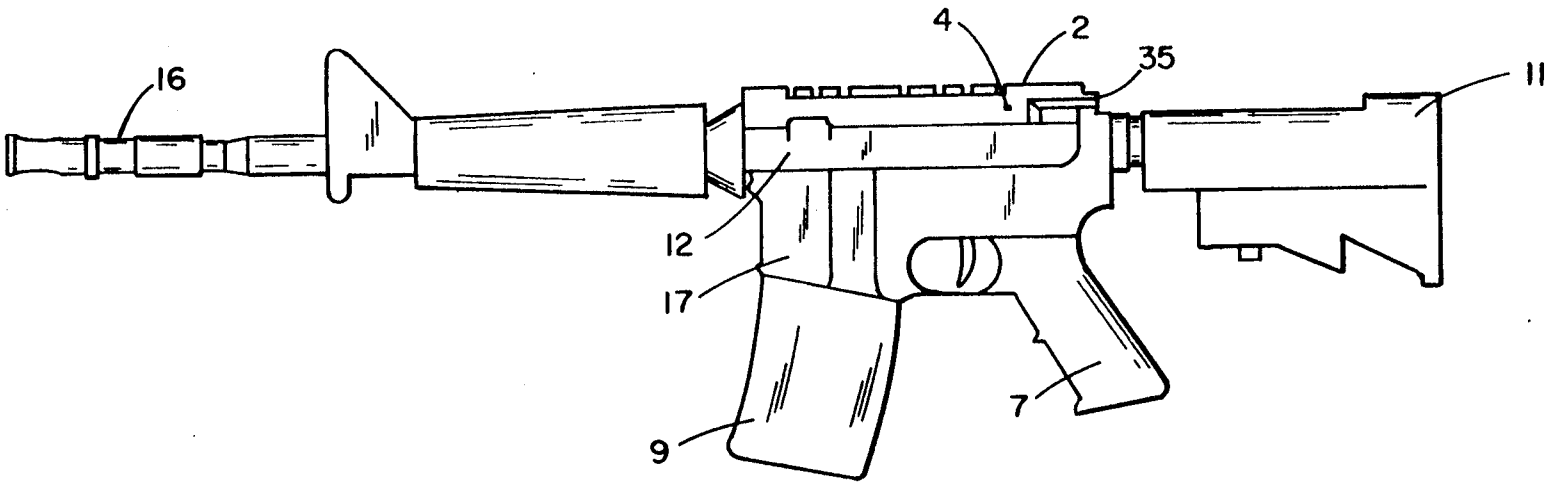
FIG. 4 is a side elevational view of a standard combat firearm with the receiver sleeve of FIG. 2B mounted thereon.

In this embodiment of the invention, the receiver sleeve 2 has pins 4 affixing it to the firearm upper receiver 12 to prevent removal from the firearm 1? by other than an official armourer. Each pin 4 passes through one of a plurality of holes 46 formed transversely through said bottom section first and second rails 42 and 43 for pinning said receiver sleeve 2 to said firearm upper receiver 12. FIG. 4 illustrates an embodiment of the receiver sleeve 2 mounted on a firearm 10. However, as may be seen in FIG. 7, in practice, the receiver sleeve 2 would incorporate a standard non-optical, flip up sight 6 at the rear 35 of the receiver top section 20. Windage and elevational adjustments 15 and 19 may also be included.

Figure 5A:
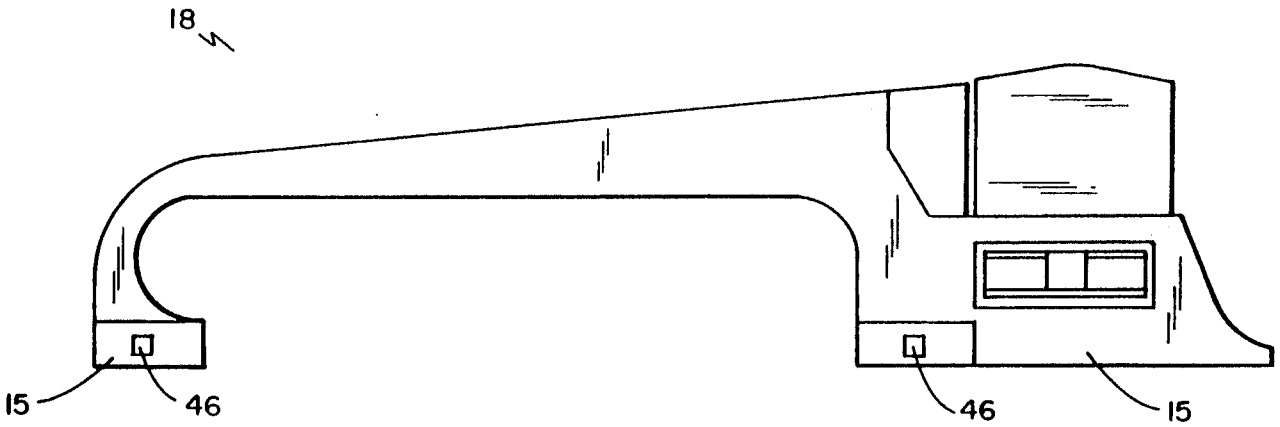
FIG. 5A is a firearm carry handle.
Figure 5B:
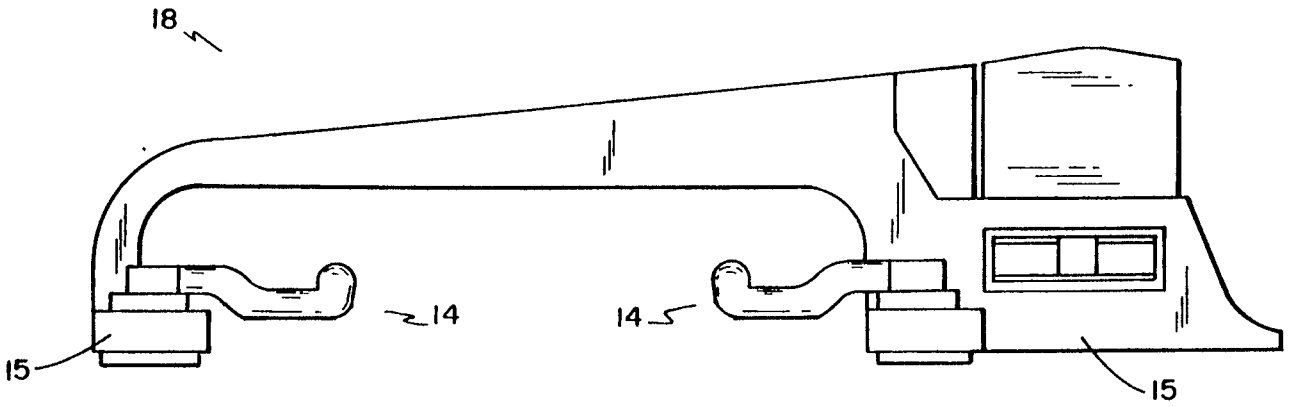
FIG. 5B is a firearm carry handle with interface lever.

As stated above, the conventional firearm handle 18 was removed in order to install the receiver sleeve 2. However, as may be seen in FIGS. 5A and 5B, a handle 18 is available for semi-permanent, non-removable installation on the receiver sleeve 2 of the present invention for firearm users who do not require optics. The handle 18 of FIG. 5A is installed directly to the receiver sleeve top section 20 and also has pin holes 46 for pinning to the receiver sleeve top section 20 thereby preventing removal by anyone other than an official armourer. Another embodiment of the handle 18 is shown in FIG. 5B. This handle 18 has two fastener devices 14 of the '871 patent type incorporated into the handle base 15. As illustrated in the '817 patent, the handle may thereby be attached about the receiver sleeve top section 20 and used to carry the firearm 10.

Figure 6A:
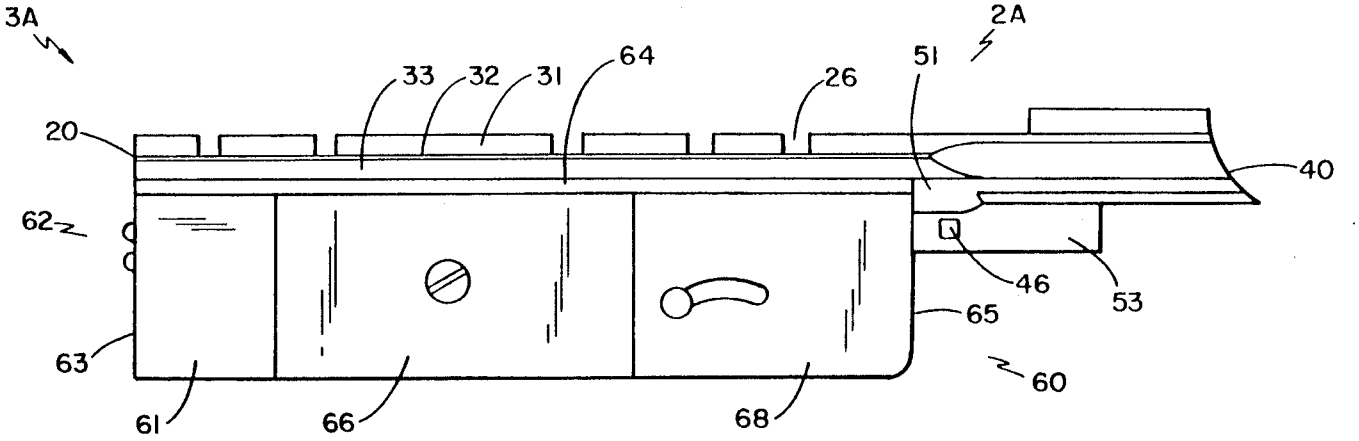
FIG. 6A is side elevational view of the receiver sleeve of FIG. 2A with laser, battery housing and optional dynamo.
Figure 6B:
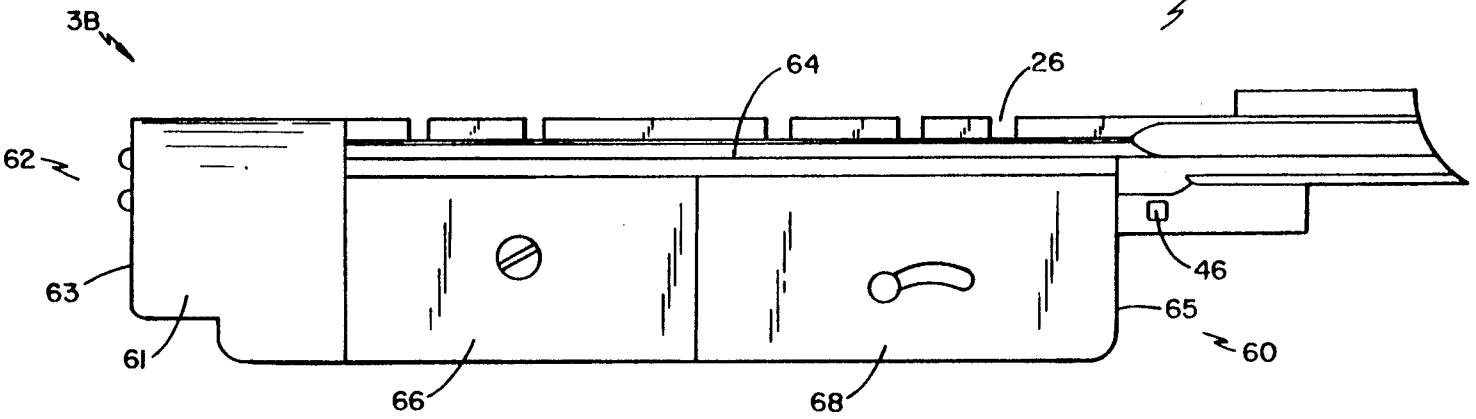
FIG. 6B is side elevational view of the receiver sleeve of FIG. 2B with laser, battery housing and optional dynamo.
Figure 7:
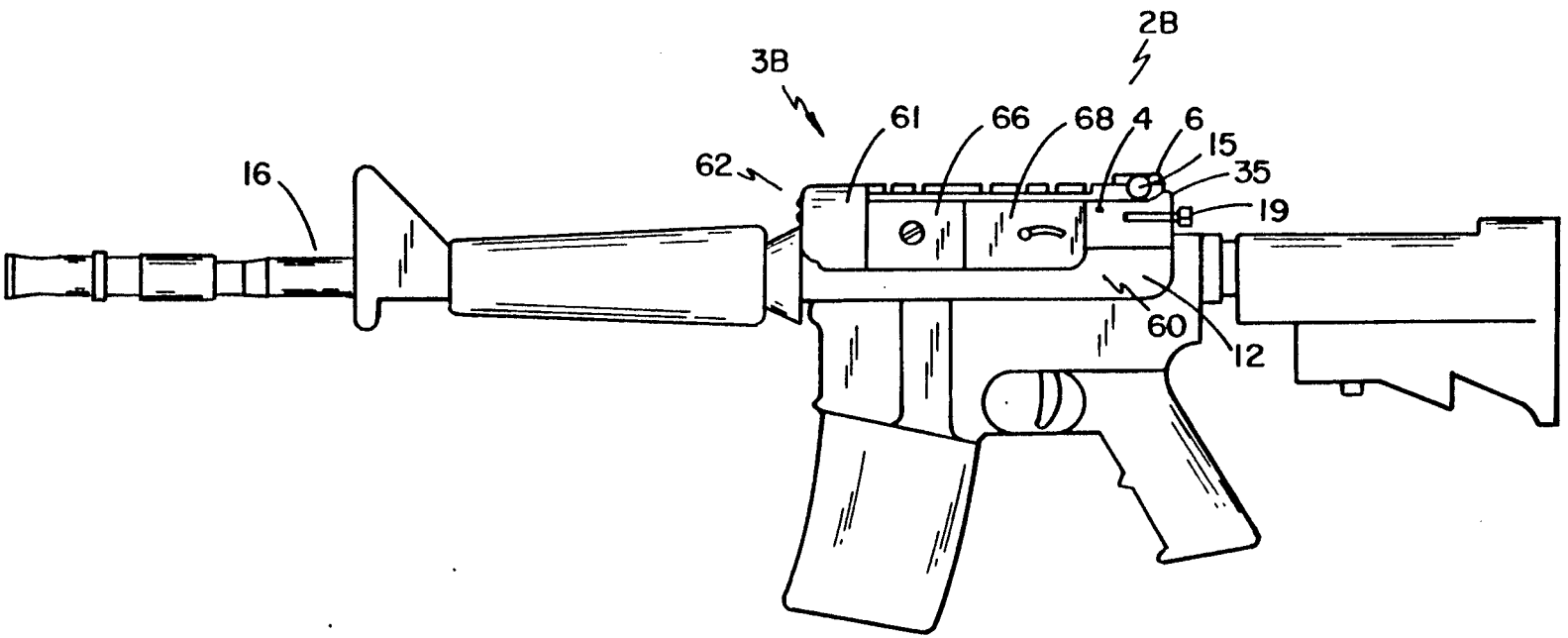
FIG. 7 is a side elevational view of a standard combat firearm with the receiver sleeve of FIG. 6B integrated thereto.
Figure 8B:
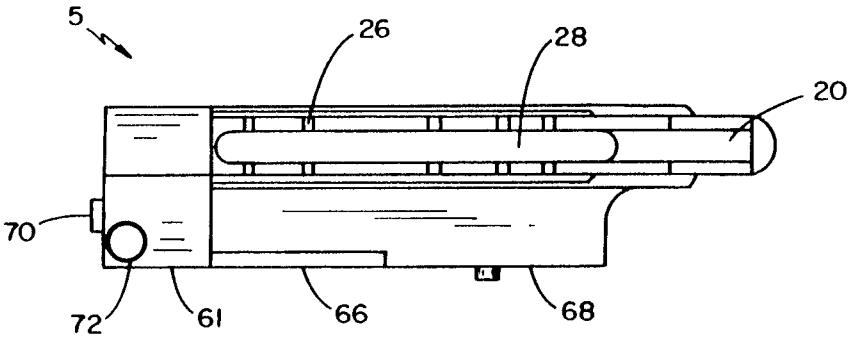
FIG. 8B is a top view of the receiver sleeve of FIG. 8A.
Figure 8D:
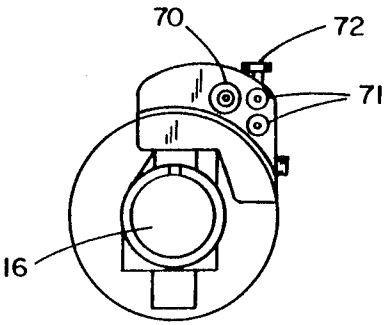
FIG. 8D is a front view of the receiver sleeve of FIG. 8A replacing the carrying handle of the firearm of FIG. 1.
Figure 8A:
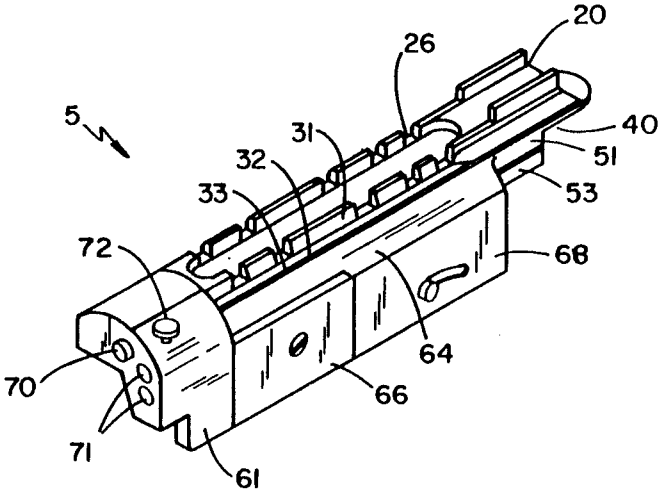
FIG. 8A is a perspective view of the receiver sleeve of FIG. 6B with active aiming capabilities.
Figure 8C:
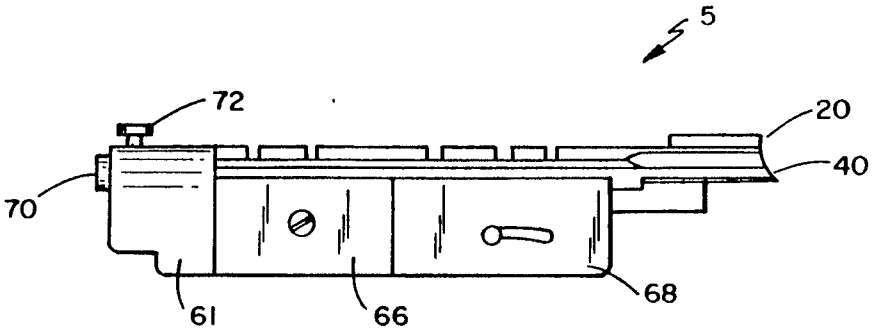
FIG. 8C is a side elevational view of the receiver sleeve of FIG. 8A.

In another embodiment of the invention illustrated in FIGS. 6A, 6B, and 7, the handle 18 of the firearm 10 illustrated in FIG. 1 is removed and a receiver sleeve 2A of standard length as illustrated in FIG. 6A or a receiver sleeve 2B of extended length as illustrated in FIG. 6B, both of which have laser capabilities and an optional dynamo, is joined to the top 13 of the upper receiver 12. The receiver sleeves 2A and 2B of FIGS. 2A and 2B have a longitudinal module 60 integrated with and positioned to the side of the receiver sleeve 2, resulting in the receiver sleeves 3A and 3B respectively. The longitudinal axis of the module 60 parallel to the longitudinal axis of the receiver sleeve 2. The module 60 has a top 64, front 63 and rear 65. The module top 64, along its inside (not shown), is attached to the bottom section first rail 42 along the first rail's angled engagement surface lower longitudinal section 53. The module 60 is comprised along its longitudinal axis of a forward laser section 61, a middle battery compartment 66, and a rearward optional dynamo 68. The laser section 61 is positioned at the barrel end of the sleeve 3, in front of and wrapping around the forward portion of the right side of the sleeve 3. A laser output cavity 62 is formed in the front 63 of the forward laser section 61. As may be seen in FIG. 7, the sleeve 3B is positioned on the receiver top 13 so that the forward laser output cavity 62 is positioned above the barrel 16. Power for the laser in this embodiment is provided by AA batteries (not shown) inserted into the battery compartment 66. An optional mechanical dynamo 68 is available immediately to the rear (firearm stock 11 end) of the battery compartment 66 wherein the dynamo 68 may be manually manipulated to recharge the batteries.

In still another embodiment of the invention illustrated in FIGS. 8A, 8B, 8C and 8D, the handle 18 of the firearm 10 illustrated in FIG. 1 is removed and a receiver sleeve 5 with visible and/or infrared (IR) illuminators 70, visible and IR aimers 71, and windage adjustment 72 is joined to the top 13 of the upper receiver 12. The receiver sleeve 5 is an enhanced version of the receiver sleeve 3 illustrated in FIGS. 6A and 6B.

It is understood that the above-described embodiment is merely illustrative of the application. The sleeve 2 provides a platform with the height necessary for optics add-ons. The receiver sleeve bottom section 40 can have vertical height and horizontal width dimension changes to accommodate different firearms. A firearm 10 can be tailored via the receiver sleeve 2 rather than requiring add-on modules to be modified for each firearm. The channel 28 is formed in the receiver sleeve top section 20 rather than in the top 13 of the upper receiver 12 to avoid weakening the receiver 12. Other embodiments may be readily devised by those skilled in the art which will embody the principles of the invention and fall within the spirit and scope thereof.

I claim:

1. An improved means for interfacing modular enhancements to a firearm having a receiver with a stock and barrel attached thereto, comprising:

a bottom firearm interface section attached to said firearm receiver and having a longitudinal axis extending in spaced, parallel relation to the longitudinal axis of said firearm, said bottom section having a longitudinal, horizontally positioned base portion along its length, said base portion having two long side edges and a first longitudinal rail extending downward from said base portion adjacent one of the long side edges and a second longitudinal rail extending downward from said base portion adjacent the other of the long side edges, wherein said second rail is in spaced parallel relationship to said first rail and a longitudinal channel is formed between said first and second rails, said channel being fitted over a portion of the firearm receiver; and a top enhancement interface section attached to said bottom interface section and having a longitudinal axis extending in spaced, parallel relation to the longitudinal axis of said firearm, said top interface section having a longitudinal, horizontally positioned base portion along its length, said base portion having two long side edges, and a first longitudinal rail extending upward from said base portion adjacent one of the long side edges and a second longitudinal rail extending upward from said base portion adjacent the other of the long side edges, wherein said second rail is in spaced parallel relationship to said first rail and a longitudinal channel is formed between said first and second rails.

2. An interface means as recited in claim 1 wherein:

said top interface section base is joined in a mirrored face to face relationship to the bottom interface section base and the joining faces of both bases have the same dimensions.

3. An interface means as recited in claim 2, wherein:

said first and second rails each have an upper surface positioned in the same horizontal plane.

4. An interface means as recited in claim 3, wherein:

each of said two long side edges of the top section base portion and rails are integral with external angled engagement surfaces which extend the full length of the top section, said surfaces each having a middle longitudinal section, upper longitudinal section, and lower longitudinal section.

5. An interface means as recited in claim 4, wherein:

said upper longitudinal section surface planes are directed outwardly and downwardly at a forty-five degree angle from the horizontal planes of the rail upper surfaces;

said middle longitudinal section surface planes are directed vertically downwardly from said upper longitudinal section surface planes in planes perpendicular to the horizontal planes of the rail upper surface planes; and said lower longitudinal section surface planes are directed inwardly and downwardly at a forty-five degree angle from the vertical planes of the middle longitudinal sections to the bottom section base side edges.

6. An interface means as recited in claim 5 wherein:

said bottom section first and second rails each have lower surfaces positioned in the same horizontal plane.

7. An interface means as recited in claim 6, wherein:

each of said two long side edges of the bottom section base portion and rails are integral with external angled engagement surfaces which extend the full length of the bottom section, said surfaces each having an upper longitudinal section and a lower longitudinal section.

8. An interface means as recited in claim 7, wherein:

said upper longitudinal section surface planes are directed outwardly and downwardly at a forty-five degree angle from the horizontal plane of the bottom section base; and said lower longitudinal section surface planes are directed vertically downwardly from said upper longitudinal section surface planes to said lower surfaces of the bottom section first and second rails, respectively.

9. An interface means as recited in claim 8, further comprising:

a series of identical and facing, rectangular notches formed transversely through said top section first and second rails.

10. An interface means as recited in claim 9, further comprising:

a plurality of holes formed transversely through said bottom section first and second rails for pinning said interface means to said firearm.

11. An interface means as recited in claim 8, further comprising:

a longitudinal module integrated with and positioned to the side of the receiver sleeve, the longitudinal axis of the module being parallel to the longitudinal axis of the receiver sleeve, said module having a top, front and rear.

12. An interface means as recited in claim 11, wherein:

said module top, along its inside, is attached to the bottom section first rail along the first rail's angled engagement surface lower longitudinal section.

13. An interface means as recited in claim 12, wherein:

said module is comprised along its longitudinal axis of a forward laser section, a middle battery compartment, and a rearward optional dynamo.

14. An interface means as recited in claim 13, wherein:

said laser section is positioned at the barrel end of the sleeve, in front of and wrapping around the forward portion of the right side of the sleeve.

15. An interface means as recited in claim 14, wherein:

laser output cavity is formed in the front of the forward laser section.

16. An interface means as recited in claim 15, further comprising:

a series of identical and facing, rectangular notches formed transversely through said top section first and second rails.

17. An interface means as recited in claim 16, further comprising:

a plurality of holes formed transversely through said bottom section first and second rails for pinning said interface means to said firearm.

* * * * *